US005884518A

United States Patent [19]

Stodt et al.

[11] Patent Number: 5,884,518

[45] Date of Patent: Mar. 23, 1999

[54] RUNOUT AND BRAKING DEVICE PARTICULARLY FOR MEDIUM STEEL ROLLED SECTIONS

[75] Inventors: Rolf Stodt, Kaarst; Hans-Peter Drügh, Zülpich, both of Germany

[73] Assignee: SMS Schloemann-Siemag Aktiengesellschaft, Dusseldorf, Germany

[21] Appl. No.: 886,961

[22] Filed: Jul. 2, 1997

[30] Foreign Application Priority Data

Jul. 4, 1996 [DE] Germany ..... 196 36 887.7

[51] Int. Cl.[6] ..... B21B 39/20

[52] U.S. Cl. ..... 72/251; 72/203; 193/35 R

[58] Field of Search ..... 72/201, 203, 250, 72/251, 252; 198/361, 457, 782; 193/35 R, 35 A, 35 SS, 35 F, 36

[56] References Cited

U.S. PATENT DOCUMENTS

| | | | |
|---|---|---|---|
| 2,628,697 | 2/1953 | Prentice | 193/35 R |
| 3,054,514 | 9/1962 | Riley | 214/1 |
| 4,193,486 | 3/1980 | Borzym et al. | 193/35 R |
| 4,554,813 | 11/1985 | Feldmann et al. | 72/251 |
| 4,555,010 | 11/1985 | Solund | 193/36 |
| 4,694,636 | 9/1987 | Griffin | 53/399 |
| 5,033,610 | 7/1991 | Lehmler et al. | 198/782 |
| 5,337,875 | 8/1994 | Lee | 193/35 R |

FOREIGN PATENT DOCUMENTS

| | | | |
|---|---|---|---|
| 2218041 | 10/1973 | Germany . | |
| 946709 | 7/1982 | U.S.S.R. | 72/10.1 |
| 1154020 | 5/1985 | U.S.S.R. | 72/251 |

*Primary Examiner*—Joseph J. Hall, III
*Assistant Examiner*—Ed Tolan
*Attorney, Agent, or Firm*—Friedrich Kueffner

[57] ABSTRACT

A runout and braking device, particularly for medium steel rolled sections, includes a run-in roller table and a braking device arranged laterally offset and parallel to the run-in roller table, wherein the run-in roller table and the braking device form a runout and braking system. The runout and braking device of the above-described type includes a braking device with a rigidly arranged braking trough with a bottom which is outwardly inclined relative to the horizontal direction. The run-in roller table includes a lifting bottom forming a plane, wherein conveying rollers mounted below the lifting bottom protrude above the plane of the lifting bottom. Pivoting devices are provided for pivoting the run-in roller table together with the lifting bottom and the conveying rollers arranged below the lifting bottom about a laterally offset pivoting point into an inclined position toward the braking trough.

8 Claims, 3 Drawing Sheets

RUNOUT AND BRAKING DEVICE PARTICULARLY FOR MEDIUM STEEL ROLLED SECTIONS

BACKGROUND OF THE INVENTION

1. Field of the Invention

The present invention relates to a runout and braking device, particularly for medium steel rolled sections. The device includes a run-in roller table and a braking device arranged laterally offset and parallel to the run-in roller table, wherein the run-in roller table and the braking device form a runout and braking system.

2. Description of the Related Art

The development of rolling mills has resulted, within short intervals, in increases of the rolling speeds. Consequently, increasing quantities of rolling stock have been supplied to the finishing departments and, when the capacities of the finishing departments could no longer keep up with the rolling capacity, the finishing departments represented a bottleneck for the entire flow of material. This resulted in the requirement that the finishing departments had to be further developed and adapted in such a way that an ever increasing rolling mill production can be handled on-line, with the tendency being toward more efficient solutions in order to increase the capacity by improved automation and simultaneously to reduce the relatively high cost of personnel.

The primary goal is to increase the speed of the entire flow of material and to provide means and measures for an orderly deposition of rolled bars in corresponding cooling bed lengths. Of particular importance is the positionally accurate deposition of individual rolled rods; specifically, predetermined cut lengths of the rolled bars must come to rest on the cooling bed in bundles with a number of commercial lengths, wherein the front ends or rear ends of the bars are aligned. In order to achieve this, controllable, fully automatic runout and braking devices are usually required between the runout of a rolling mill and the entry of a cooling bed.

A device of this type is known, for example, from DE-0S 2 218 041. In this device, a rolled bar emerging from the rolling train passes initially a cutting device for cropping the useless front ends of the rolled bar and is then conducted onto a runout roller table. In the runout roller table, a braking roller table which can be lifted on one side is activated and the braking action of the rod moving on the table is initiated. In the known device, such a braking roller table is composed of conveying rollers arranged with a slight inclination relative to the rolling axis, wherein the conveying rollers displace the rolled bar over the entire length toward the cooling bed side. As soon as the rolled bar is moved laterally out of the area of the runout roller table and onto the braking roller table, the braking roller table is lowered and the runout roller table is again available for receiving another rolled bar. Depending on the section type of the rolled bar, the braking roller table is controlled in such a way that cropping of the front end of the bar can be carried out in the cutting device in a predetermined length or, if the rolled bars do not have to be cropped, a final position is reached which is located in front of the cutting device. If the rolled bars are to be straightened, they pass a straightening machine and are subsequently supplied through the run-out roller table to the cooling bed. In the known device, as shown in FIG. 1, the braking device in the form of a braking roller table is arranged parallel to the runout roller table.

In accordance with other known solutions for constructing a runout area together with braking devices, braking slides may be arranged within a roller table or wipers for laterally wiping rolled sections in the form of a dropping movement into the side wall may be provided.

Braking slides have the disadvantage that, in the case of relatively low rolling speeds, a quick and safe transverse movement does not take place on the braking slides which are being raised. On the other hand, the use of wipers has the disadvantage that pull rods for the common pivoting movement of the wipers, which are subjected to thermally caused length changes, may lead to undesired pivoting movements. Moreover, an abrupt wiping to the side and the resulting rough dropping movement into the side wall may lead to deformations, particularly in the case of thin-walled I-beam sections.

SUMMARY OF THE INVENTION

Therefore, it is the primary object of the present invention to provide a significantly improved runout and braking device which makes possible a safe and quick transverse conveyance of rolled sections from the run-in area into the braking area, while avoiding the above-described disadvantages and difficulties. In addition, the device should be uncomplicated and should especially guarantee a careful treatment of the rolled material without section deformations.

In accordance with the present invention, the run-out and braking device of the above-described type includes a braking device with a rigidly arranged braking trough with a floor which is outwardly inclined relative to the horizontal direction, the run-in roller table including a lifting bottom forming a plane, wherein conveying rollers mounted below the lifting bottom protrude above the plane of the lifting bottom, and a pivoting means for pivoting the run-in roller table together with the lifting bottom and the conveying rollers arranged below the lifting bottom about a laterally offset pivoting point into an inclined position toward the breaking troth.

Since the run-out and braking device according to the present invention is constructed as an interacting functional unit composed of a run-in roller table and a fixedly arranged braking trough, a quick and safe transverse movement on the conveying plane of the upwardly pivotable conveying rollers is achieved independently of the existing rolling speeds.

The rollers mounted on the lifting floor are raised together with the floor after a section has entered, so that, after the upper lifting position has been reached, the inclined position of the system makes it possible that the rolled material is conveyed transversely, easily and quickly. On the rotating rollers which are slightly inclined in alternate directions, a rolled section slides without danger of deformation transversely of the conveying direction into the braking area and, after the rollers have been lowered within a controlled period of time, the rolled section is rapidly decelerated.

Because wipers are not provided in this arrangement, the corresponding component of the run-out and braking device is significantly simplified. By avoiding the abrupt lateral wiping and the resulting rough ejection movement into the side wall, deformations are avoided in an advantageous manner, particularly of thin-rolled I-beam sections.

In accordance with a further development of the present invention, the braking trough and the run-in roller table are arranged relative to each other in such a way that, in the raised position of the pivotable run-in roller table, the conveying plane formed by the conveying rollers of the run-in roller table protrudes above and extends parallel to the floor of the braking trough, wherein the floor of the braking trough and the lifting bottom form a common inclined plane.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
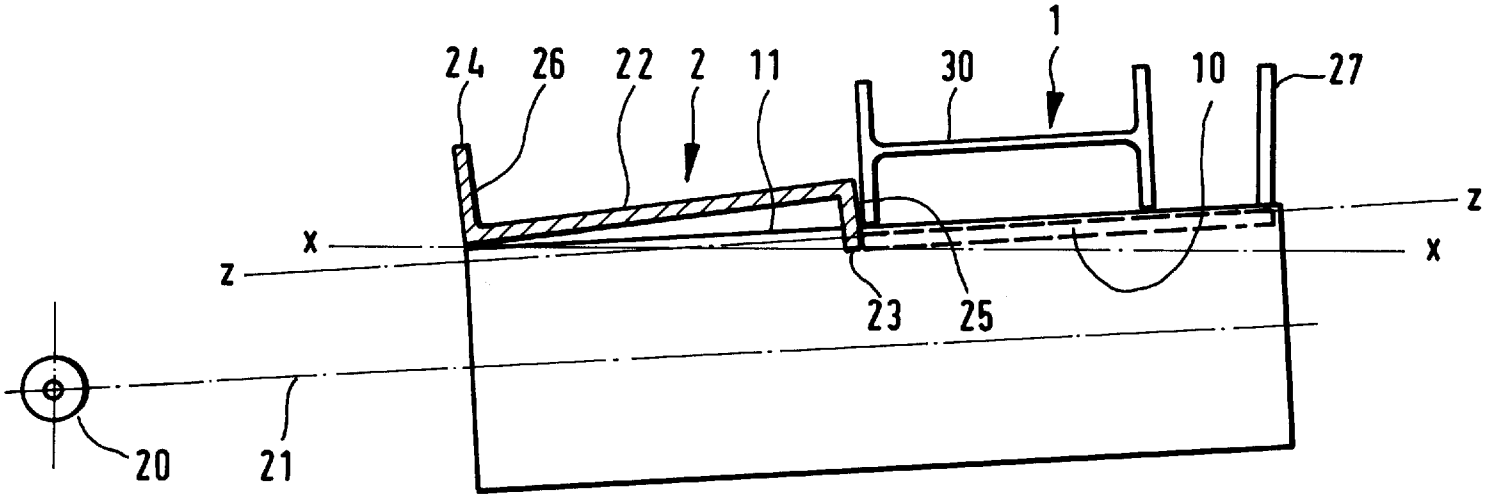
FIG. 1 is a schematic cross-sectional view of a run-out and braking device with a run-in roller table in a lowered position and a braking trough parallel to and laterally offset of the run-in roller table.
Figure 2:
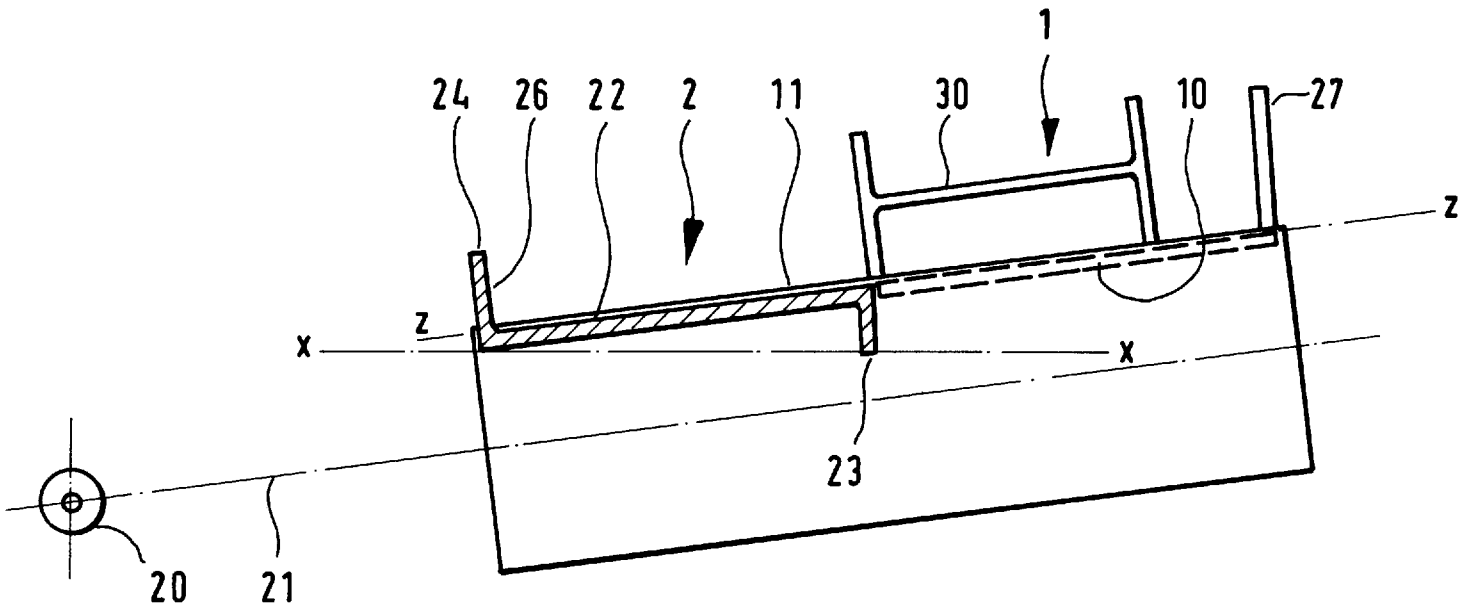
FIG. 2 is a cross-sectional view, similar to FIG. 1, showing the run-in roller table in the raised pivoting position.
Figure 3:
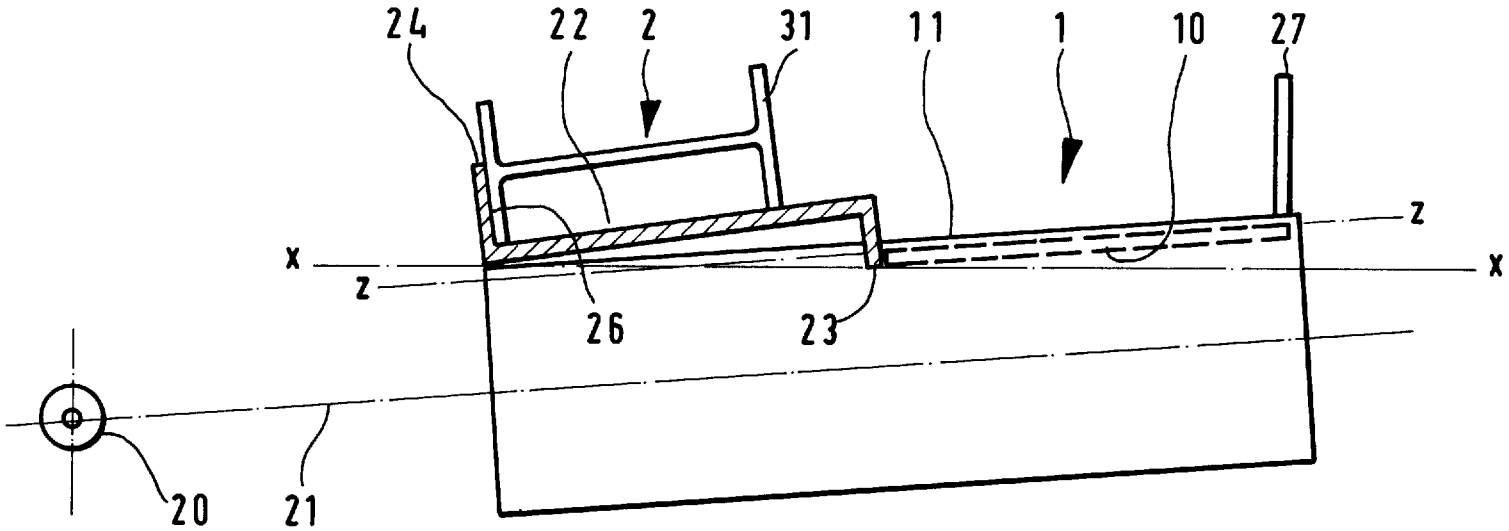
FIG. 3 is a cross-sectional view, again similar to FIG. 1, showing the run-in roller table in the lowered position after a section has been transversely conveyed into the braking trough.

FIGS. 1–3 of the drawing illustrate the construction of the runout and braking device of the present invention as well as the interaction and operation of the elements thereof.

FIG. 1 shows the run-in roller table 1 and a braking device arranged laterally offset and parallel to the roller table 1. The braking device is a fixedly mounted braking trough which includes a bottom 22 which is outwardly inclined relative to the horizontal direction x—x. The adjacent run-in roller table 1 is constructed with a lifting bottom 10, wherein conveying rollers 11 mounted below the lifting bottom 10 protrude above the plane z—z of the lifting bottom 10. These rollers 11 extend across the width of the run-in roller table 1 as well as of the braking trough 2.

As further illustrated in FIG. 1, the run-in roller table 1. is equipped with pivoting means 21 for upwardly pivoting the run-in roller table 1 together with the lifting bottom and the conveying rollers 11 mounted in the lifting bottom 10 about a laterally offset pivoting point 20 into an inclined position which drops downwardly toward the braking trough 2.

FIG. 2 of the drawing shows the run-in roller table 1 in the upwardly pivoted position. As can be seen in FIG. 2, the braking trough 2 and the run-in roller table 1 are arranged relative to each other in such a way that, in the raised position of the pivotable run-in roller table 1, the conveying plane formed by the conveying rollers 11 of the roller table 1 protrudes above and extends parallel to the bottom 22 of the braking trough 2, so that the bottom 22 and the lifting bottom 10 form a common inclined plane z—z. This configuration of the run-in roller table 1 and the braking trough 2 makes it possible to easily and quickly transversely convey the rolled material 30 after the upper lifting position has been reached. Thus, the rolled material 30 slides on the slightly inclined rotating conveying rollers 11 without the danger of a deformation transversely into the braking area of the braking trough 2 and is carefully decelerated in the braking trough 2 as a result of natural sliding friction. By appropriately controlling the lifting movement of the pivoting means 21, the beginning of the braking process can be controlled with respect to time and location.

As further illustrated in FIGS. 1 to 3, the braking trough 2 has a Z-shaped cross-section with a downwardly directed leg 23 adjacent the run-in roller table 1 and an upwardly directed leg 24 at the outer side of the bottom 22, wherein, in the lowered position of the run-in roller table 1, the downwardly directed leg 23 serves as a lateral guide means 25 for rolled sections 30 travelling on the roller table 1 and the upwardly directed leg 24 is constructed as a lateral guide means 26 for a rolled section 31 located in the braking trough 2 as shown in FIG. 3.

In accordance with a further development of the device according to the present invention, the run-in roller table 1 includes an angle section with a floor 10 with openings, wherein conveying rollers 11 mounted below the angle section extend in the openings of the bottom 10. A vertical leg 27 forms the outer side of the angle section.

In accordance with another very advantageous feature, which is already known in the art, the axes of rotation of the conveying rollers 11 are arranged at an inclined angle relative to an axis extending perpendicularly to the longitudinal axis of the run-in roller table 1 which corresponds to the rolling line, so that a rolled section 30 travelling on the rollers 11 is conveyed with a component of movement in transverse direction toward the braking trough.

The angle of inclination may be between 2° and 20°, preferably about 10°.

In accordance with an advantageous further development of the runout and braking device, a plane extending across the vertices of the conveying rollers 11 protrudes slightly above the lifting bottom 10 of the roller table 1.

The device according to the present invention operates as follows:

A rolled bar 30 rolls at final rolling speed out of a rolling train. After passing a cutting device for cropping a head piece which cannot be used and after separating the rolled material as desired into predetermined cut pieces, each cut piece travels into the run-in roller table 1 of the runout and braking device. When the piece has travelled a conveying distance predetermined by technical measuring means, not shown, the run-in roller table 1 is pivoted together with the rolled section 30 and the conveying rollers 11 upwardly into the position shown in FIG. 2 after the pivoting means 21 have been activated without interrupting the conveying movement of the rolled section 30. After reaching the upper lifting position, a slight and quick transverse conveyance of the rolled material 30 begins, wherein the material is conveyed on the conveying plane formed by the vertices of the conveying rollers 11 transversely over the conveying plane up to the braking trough 2. Immediately subsequently, the run-in roller table 1 with the conveying rollers 11 is pivoted downwardly into the lowered position shown in FIG. 3, so that the section 31 is placed on the solid floor 22 of the braking trough 2 and is decelerated as a result of sliding friction.

It is apparent that the device according to the present invention is uncomplicated and effective and especially insures a careful treatment of the rolled material 30, 31 and, thus, meets the above object in an optimum manner.

While specific embodiments of the invention have been shown and described in detail to illustrate the inventive principles, it will be understood that the invention may be embodied otherwise without departing from such principles.

We claim:

1. A runout and braking device, particularly for medium steel rolled sections, the device comprising a run-in roller table and a braking device arranged laterally offset and parallel to the run-in roller table, wherein the run-in roller table and the braking device form a runout and braking system, the braking device comprising a rigidly mounted braking trough having a bottom, wherein the bottom of the braking trough is inclined relative to a horizontal direction, the run-in roller table comprising a lifting bottom defining a plane, wherein conveying rollers are mounted below the lifting bottom, the conveying rollers protruding above the plane of the lifting bottom, and a pivoting means for pivoting the run-in roller table together with the lifting bottom and the conveying roller arranged below the lifting bottom about a laterally offset pivoting point into an inclined position toward the braking trough.

2. The runout and braking device according to claim 1, wherein the conveying rollers of the run-in roller table form a conveying plane, the braking trough and the run-in roller table being mounted relative to each other such that, in a raised position of the pivotable run-in roller table, the conveying plane protrudes above and extends parallel to the floor of the braking trough, wherein the floor of the braking trough and the lifting bottom form a common inclined plane.

3. The runout and braking device according to claim 2, wherein the braking trough has a Z-shaped cross-section, the braking trough comprising a downwardly directed leg adjacent the run-in roller table and an upwardly directed leg at an outer side of the floor, whereby the downwardly directed leg, in a lowered position of the run-in roller table, is configured to serve as a lateral guidance for rolled sections placed on the run-in roller table, and the upwardly directed leg is configured to serve as a lateral guidance for rolled sections located in the braking trough.

4. The runout and braking device according to claim 1, wherein the run-in roller table comprises an angle section with a floor and a vertical leg at an outer side of the floor of the angle section, the conveying rollers protruding through openings in the floor of the angle section.

5. The runout and braking device according to claim 1, wherein the run-in roller table has a longitudinal axis, the conveying rollers having axes of rotation arranged at an inclined angle relative to an axis extending perpendicularly to the longitudinal axis of the run-in roller table, whereby a rolled section travelling on the conveying rollers is conveyed with a transverse component of movement toward the braking trough.

6. The runout and braking device according to claim 5, wherein the angle of inclination of the conveying rollers is between 2° and 20°.

7. The runout and braking device according to claim 5, wherein the angle of inclination of the conveying rollers is between 10° and 20°.

8. The runout and braking device according to claim 1, wherein a plane extending across vertices of the conveying rollers protrudes by a few millimeters above the lifting bottom of the roller table.

* * * * *